US010832884B2

(12) United States Patent
Kim et al.

(10) Patent No.: US 10,832,884 B2
(45) Date of Patent: Nov. 10, 2020

(54) CYLINDRICAL X-RAY TUBE AND MANUFACTURING METHOD THEREOF

(71) Applicant: VALUE SERVICE INNOVATION CO., LTD., Cheongju-si (KR)

(72) Inventors: Dae Jun Kim, Daejeon (KR); Kwan Soo Park, Cheongju-si (KR); Ji Eun Kim, Daejeon (KR); Dong il Kim, Daejeon (KR); Chung Yeol Lee, Daejeon (KR); Do Yun Kim, Daejeon (KR)

(73) Assignee: VALUE SERVICE INNOVATION CO., LTD., Cheongju-si (KR)

( * ) Notice: Subject to any disclaimer, the term of this patent is extended or adjusted under 35 U.S.C. 154(b) by 0 days.

(21) Appl. No.: 16/485,733

(22) PCT Filed: Aug. 16, 2017

(86) PCT No.: PCT/KR2017/008909
§ 371 (c)(1),
(2) Date: Aug. 13, 2019

(87) PCT Pub. No.: WO2019/022282
PCT Pub. Date: Jan. 31, 2019

(65) Prior Publication Data

US 2020/0144016 A1 May 7, 2020

(30) Foreign Application Priority Data

Jul. 28, 2017 (KR) ..... 10-2017-0095915

(51) Int. Cl.
*H01J 35/06* (2006.01)
*H01J 35/16* (2006.01)

(52) U.S. Cl.
CPC ..... *H01J 35/065* (2013.01); *H01J 35/064* (2019.05); *H01J 35/066* (2019.05); *H01J 35/16* (2013.01)

(58) Field of Classification Search
CPC ..... H01J 35/065; H01J 35/066; H01J 35/064; H01J 35/16; H01J 35/112; H01J 2235/023; H01J 35/04
See application file for complete search history.

(56) References Cited

U.S. PATENT DOCUMENTS 9,818,571 B2 * 11/2017 Shiozawa ..... H01J 35/14
2003/0021377 A1 * 1/2003 Turner ..... H01J 35/32 378/102

(Continued)

FOREIGN PATENT DOCUMENTS

KR 10-2016-0102741 8/2016
KR 10-2016-0102744 8/2016
KR 10-2017-0022852 3/2017

OTHER PUBLICATIONS

International Search Report for International Application No. PCT/KR2017/008909, dated Feb. 26, 2018.

(Continued)

*Primary Examiner* — Kiho Kim
(74) *Attorney, Agent, or Firm* — Kile Park Reed & Houtteman PLLC

(57) ABSTRACT

A cylindrical X-ray tube having an outer insulating layer, a cathode electrode and an anode electrode disposed at both ends of the outer insulating layer, a gate electrode disposed between the cathode and anode electrodes, an emitter, and a target, comprises an inner insulating layer which is disposed between the cathode electrode and the outer insulating layer, is formed to extend downward in a coaxial direction with the outer insulating layer, and is pre-adjusted in order to secure an insulating distance between the cathode electrode and the (Continued)

gate electrode. Thus, by providing a separate internal insulating layer extending coaxially with the external insulating layer between the cathode electrode and the external insulating layer, the insulating distance between the cathode electrode and the gate electrode, the insulating distance between the cathode electrode and the anode electrode may be easily adjusted, so that a desired insulating capability can be secured.

11 Claims, 7 Drawing Sheets

(56) References Cited

U.S. PATENT DOCUMENTS

| | | | | |
|---|---|---|---|---|
| 2012/0148027 | A1 | 6/2012 | Jeong et al. | |
| 2013/0022173 | A1 | 1/2013 | Jeong et al. | |
| 2013/0170623 | A1 | 7/2013 | Reynolds et al. | |
| 2016/0079029 | A1* | 3/2016 | Li | H01J 35/06 378/122 |
| 2019/0348249 | A1* | 11/2019 | Hoffman | H05G 1/06 |

OTHER PUBLICATIONS

Written Opinion for International Application No. PCT/KR2017/008909, dated Feb. 26, 2018.

* cited by examiner

CYLINDRICAL X-RAY TUBE AND MANUFACTURING METHOD THEREOF

TECHNICAL FIELD

The present invention relates to a cylindrical X-ray tube and a method thereof, and more particularly to a cylindrical X-ray tube and a method thereof for emitting X-rays by colliding accelerated electrons emitted from an emitter with a target on the anode electrode.

BACKGROUND ART

In general, an X-ray tube is widely used for a variety of inspection apparatuses or diagnosis apparatus for medical diagnosis, non-destructive test or chemical analysis The conventional X-ray tube uses a hot cathode of tungsten as an electron emitting source, and has a structure of a thermionic type in which a tungsten filament is heated to emit electrons and the emitted electrons collide with a target on the anode electrode side to generate X-rays.

However, since the thermionic type X-ray tube has to raise the tungsten filament to a high temperature of more than 1000 degrees for electron emission, additional power is consumed to emit electrons, and the generated electrons are emitted randomly from the tungsten surface having a spiral structure. There is a problem that X-ray emission efficiency and focusing performance are significantly deteriorated.

In consideration of this problem, researches on field emission type X-ray tubes using nanostructures such as carbon nanotubes (CNTs) as cold cathode electron emission sources have been actively conducted.

The field emission type X-ray tube has a structure including a cathode electrode and an anode electrode respectively disposed at both ends of a vacuum tube made of ceramic material, and a gate electrode disposed between the cathode electrode and the anode electrode, as disclosed in the patent reference 1. Here, the electron beam emitted from the emitter by the electric field formed between the cathode electrode and the gate electrode is accelerated by the electric field formed between the anode electrode and the cathode electrode, and collides with the target formed on the anode electrode side, and X-rays are generated.

Such a carbon nanotube-based field emission type X-ray tube is advantageous in that no power loss due to heat is generated as compared with a thermionic X-ray tube, and emitted electrons are emitted along the longitudinal direction of the carbon nanotube. The directivity of electrons toward the target is excellent, and the x-ray emission efficiency and focusing performance are improved. In addition, the electron emission from the thermionic is performed by analog due to the warm-up time unique to the filament. However, in case of cold cathode CNT field emission, as the warm-up time is unnecessary, digital driving is possible due to its very speedy on-off characteristic.

On the other hand, in case of the above-described field emission type X-ray tube, a very high potential difference of several kV to several hundreds of kV is formed between the anode electrode and the cathode electrode, and a high potential difference between the anode electrode and the gate electrode, Is formed. Because of this high potential difference, the x-ray tube, which is embodied as an insulated vacuum tube between the anode electrode and the cathode electrode, between the anode electrode and the gate electrode, or between the gate electrode and the cathode electrode, an electric field breakdown phenomenon occurs in which the conductivity, suddenly increases, unless insulation is sufficient. This electric field breakdown phenomenon is obstructing the miniaturization of the field emission type X-ray tube. In addition, when a terminal portion of the gate electrode for connection to the external power supply circuit is exposed to the side of the X-ray tube, an insulation distance between the gate electrode and the anode electrode is shortened. There is a problem in that the efficiency of the manufacturing process is deteriorated because the structure is changed or the gate electrode and the external power supply circuit are electrically connected to each other at the side of the vacuum tube.

(Patent Reference 1) KR2016-0102741 A (Patent Reference 2) KR2016-0102744 A

DISCLOSURE

Technical Problem

Therefore, according to the present invention, it is possible to secure a sufficient insulating capability between a cathode electrode and a gate e according to the emitter output specification of the field emission type X-ray tube. In particular, the present invention also provides a cylindrical X-ray tube and a method of manufacturing the same that can realize a structure that can easily ensure insulation capability between a cathode electrode and a gate electrode and can improve the efficiency of a manufacturing process.

Technical Solution

A cylindrical X-ray tube according to an embodiment of this invention includes an outer insulating layer, a cathode electrode and an anode electrode disposed at both ends of the outer insulating layer, a gate electrode disposed between the cathode electrode and the anode electrode, an emitter, a target, and an inner insulating layer which is disposed between the cathode electrode and the outer insulating layer, is formed to extend downward in a coaxial direction with the outer insulating layer, and is pre-adjusted in order to secure an insulating distance between the cathode electrode and the gate electrode.

The cathode electrode may be spaced apart from the gate electrode by a predetermined distance, while hermetically sealing a bottom surface of the inner insulating layer so as not to be exposed the bottom surface of the inner insulating layer to outside and extending upward in a coaxial direction with the inner insulating layer.

The bottom surfaces of the cathode electrode and the gate electrode may be electrically contacted to an external power supply circuit.

The emitter may be formed of a nanostructure made of carbon nanotubes.

The gate electrode may be spaced apart from the cathode electrode by a predetermined distance, while hermetically sealing the bottom surface of the outer insulating layer so as not to be exposed the bottom surface of the outer insulating layer to the outside and extending upward in a coaxial direction with the outer insulating layer.

A lower space of the inner insulating layer may be hermetically sealed by the cathode electrode, a space between the inner insulating layer and the outer insulating layer may be hermetically sealed by the gate electrode, and an upper space of the outer insulating layer may be hermetically sealed by the anode electrode.

A focusing electrode may be further included on the gate electrode, for focusing electron beam accelerating toward the anode electrode.

A manufacturing method of a cylindrical X-ray tube according to an embodiment of this invention includes A manufacturing method of a cylindrical X-ray tube comprising, forming an inner insulating layer, forming a cathode electrode which is spaced apart from an upper opening surface of the inner insulating layer by a predetermined distance, is extended upward while hermetically sealing a lower surface of the inner insulating, forming an outer insulating layer in a coaxial direction by which is outward spaced apart from the inner insulating layer by a predetermined distance, forming a gate electrode which is spaced apart from the cathode electrode by a predetermined distance, is extended upward while hermetically sealing a lower surface of the outer insulating layer, and forming an anode electrode by hermetically sealing an upper surface of the outer insulating layer, extending upwardly, and hermetically sealing an opening surface of the outer insulating layer.

An emitter may be disposed on the cathode electrode after the step of forming a cathode electrode.

A focusing electrode may further formed on the gate electrode in order to focus electron beam traveling toward the anode electrode before the step of forming an anode electrode.

The emitter may be formed of a nanostructure made of carbon nanotubes.

Advantageous Effects

According to such a cylindrical X-ray tube and its manufacturing method, an insulating layer formed between a cathode electrode and an outer insulating layer so as to extend coaxially with the outer insulating layer is additionally provided, so that the insulation distance between the cathode electrode and the gate electrode, The insulation distances between the electrode and the anode electrode and between a cathode electrode and an anode electrode can be easily controlled to secure a desired insulating capabilities.

In addition, by forming a gate terminal portion of the gate electrode on the lower surface of an outer insulating layer, the cathode electrode and the gate electrode can be positioned in the same direction, and the simplification and efficiency of the manufacturing process can be improved.

MODE FOR INVENTION

Figure 1:
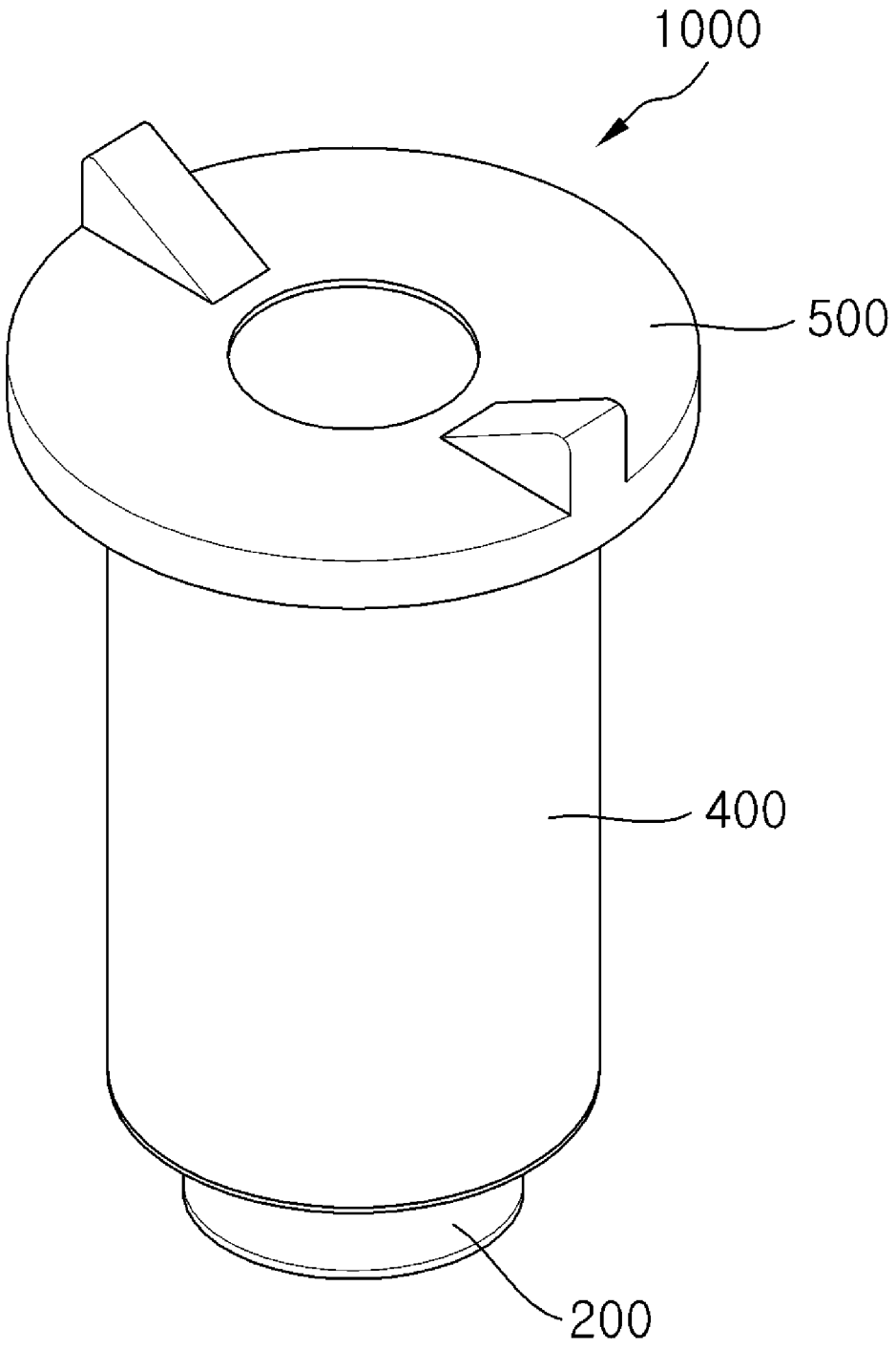
FIG. 1 is a perspective view of an X-ray tube according to an embodiment of the present invention.

The above and other features and advantages of the present invention will become more apparent from the following detailed description of the present invention when taken in conjunction with the accompanying drawings. It will be apparent to those skilled in the art that various modifications and variations can be made in the present invention without departing from the spirit or scope of the invention. The present invention is capable of various modifications and various forms, and specific embodiments are illustrated in the drawings and described in detail in the text. It is to be understood, however, that the invention is not intended to be limited to the particular forms disclosed, but on the contrary, is intended to cover all modifications, equivalents, and alternatives falling within the spirit and scope of the invention. The specification and cases below are for showing embodiments of the present invention but only for examples, and the present invention may, however, be embodied in many different forms and should not be construed as limited to the example embodiments set forth herein.

It will be understood that, although the terms first, second, third etc. may be used herein to describe various elements, components, regions, layers and/or sections, these elements, components, and/or sections should not be limited by these terms. These terms are only used to distinguish one element, component, region, layer or section from another region, layer or section. Thus, a first element, component, or section discussed below could be termed a second element, component, or section without departing from the teachings of the present invention.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs.

It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described with reference to the accompanying drawings.

Figure 2:
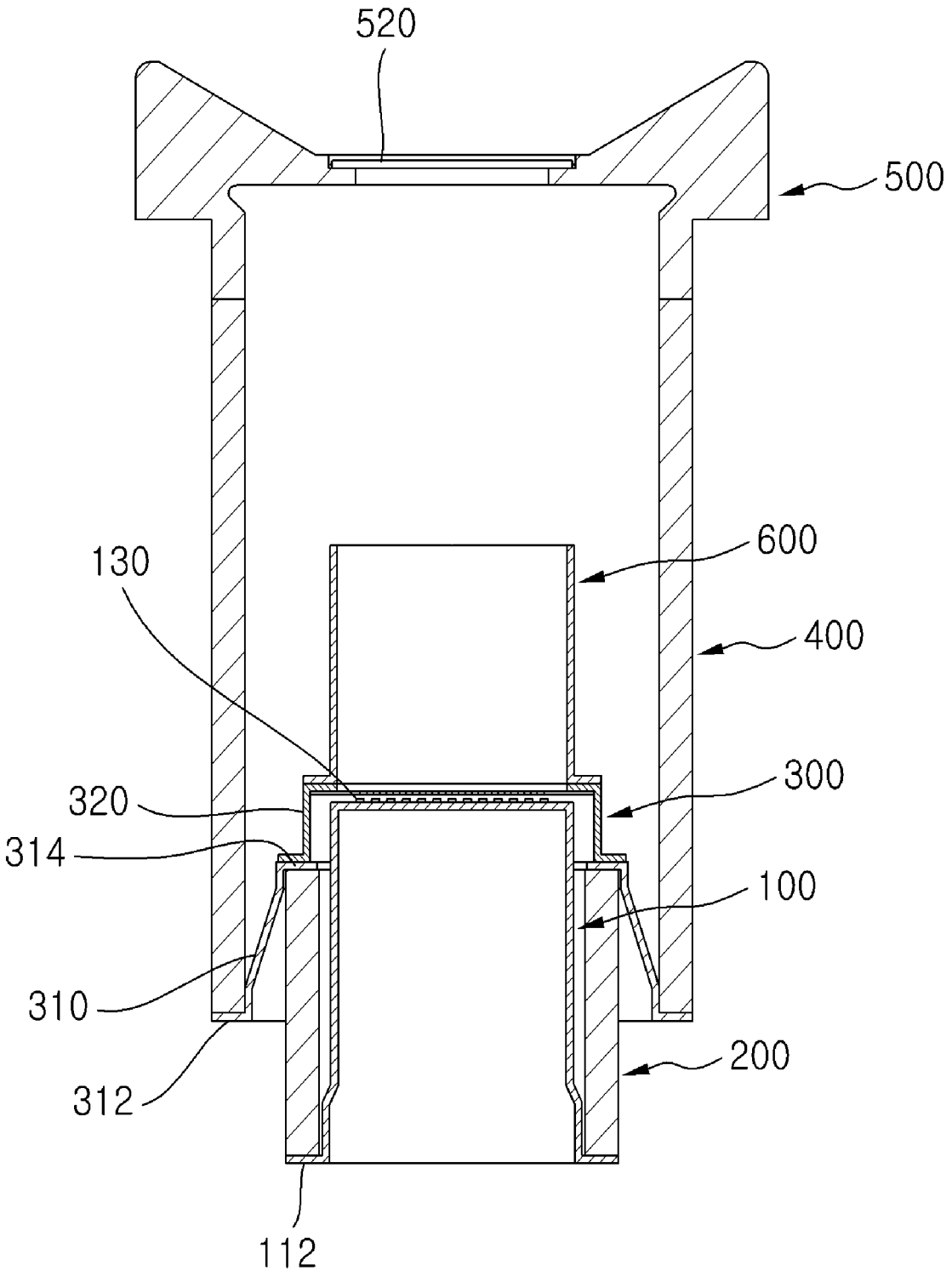
FIG. 2 is a schematic cross-sectional view showing an X-ray tube shown in FIG. 1.

FIG. 1 is a perspective view of an X-ray tube according to an embodiment of the present invention and FIG. 2 is a schematic cross-sectional view showing an X-ray tube shown in FIG. 1.

Referring to FIG. 1 and FIG. 2, a cylindrical X-ray tube 1000 according to an embodiment of the present invention comprises an outer insulating layer 400, a cathode electrode 100 and an anode electrode 500 disposed at both ends of the outer insulating layer 400, a gate electrode 300 disposed between the cathode electrode 100 and the anode electrode 500. The cylindrical X-ray tube 1000 also has an inner insulating layer 200 which is disposed between the cathode electrode 100 and the outer insulating layer 400, is formed to extend inward in a coaxial direction with the outer insulating layer 400.

While the size of an X-ray tube is getting smaller, the output of the emitter is, in general, required to be higher power. In particular, X-ray tubes used in medical applications require emitter output of 100 to 300 mA. However, in order to apply such a high-power emitter to a small-sized X-ray tube, it is necessary to ensure sufficient insulation between the cathode and gate electrodes due to higher output of the emitter. On the other hand, the x-ray tube is composed of various x-ray tubes according to the emitter output specification, and simple manufacturing is essential for improving productivity of these various X-ray tubes. In this embodiment, it is possible to manufacture an X-ray tube by efficiently pre-adjusting a relative length between the inner insulating layer and the outer insulating layer, and securing required insulating distance.

For example, in the cylindrical X-ray tube 1000 according to an embodiment of the present invention, the lower ends of the cathode electrode 100 and the gate electrode 300 hermetically seal the bottom surfaces of the inner insulating layer 200 and the outer insulating layer 400, respectively, so as to electrically connect to an external power supply circuit (not shown). Therefore, an insulating capability between the inner and outer insulating layers 200 and 400 can be easily adjusted based on the relative length between the inner and outer insulating layers 200 and 400, thereby easily securing an insulating capability based on the emitter output specification of an X-ray tube.

Since the cylindrical X-ray tube 1000 according to the embodiment of the present invention has a cylindrical shape in which the inner and outer insulating layers 200 and 400 are coaxial and the inner insulating layer 200 only protrudes downward, it may be easily connected to an external electric circuit by connectors (not shown). Therefore, it has a structure capable of securing an infinite insulating capability between the cathode electrode 100 and the gate electrode 300 by a simple manufacturing process.

The cathode electrode 100 hermetically seals the lower surface of the inner insulating layer 200, is spaced apart from the gate electrode 300 by a predetermined distance and extends upward in a coaxial direction with the inner insulating layer 200.

The emitter 130, an electron emission source that emits electrons, is formed on the cathode electrode 100. The emitter 130 may be formed of a plurality of nanostructures such as, for example, carbon nanotubes. When the emitter 130 is formed by the carbon nanotubes, a plurality of carbon nanotubes may be directly grown on the surface of the cathode electrode 100 by chemical vapor deposition (CVD), or baking and the like after printing a carbon nanotube paste.

In the present embodiment, the inner insulating layer 200 is formed in the shape of a cylindrical tube so as to surround the side surface of the cathode electrode 100. The inner insulating layer 200 may be formed of an insulating material such as ceramic, glass, or silicon, and may be formed of, for example, a material of alumina ceramics.

The inner insulating layer 200 is formed in a cylindrical shape with an open top and a bottom so as to accommodate the cathode electrode 100 therein and the diameter of the inner insulating layer 200 is smaller than the diameter of the r insulating layer 400 to accommodate in the outer insulating layer 400. The inner insulating layer 200 is disposed inside the outer insulating layer 400 in a coaxial direction with the outer insulating layer 400. At least a part of the inner insulating layer 200 is formed to protrude from the outer insulating layer 400 in order to increase both the insulating distances between the cathode electrode 100 and the gate electrode 300, or between the cathode electrode 100 and the anode electrode 500.

The gate electrode 300 is disposed outside the inner insulating layer 200, and the lower end of the gate electrode 300 is formed to seal the lower surface of the outer insulating layer 400. A gate terminal 312 is formed on the lower end of the gate electrode 300 for electrical connection to an external power supply circuit. The gate electrode 300 hermetically seals the lower surface of the outer insulating layer 400 so as not to expose to the outside and extends in a coaxial direction with the outer insulating layer 400 and is spaced apart from the cathode electrode 100 by a predetermined distance FIG. 3 is a perspective view showing the gate electrode shown in FIG. 2, and FIG. 4 is a cross-sectional view showing the gate electrode shown in FIG. 3.

Figure 3:
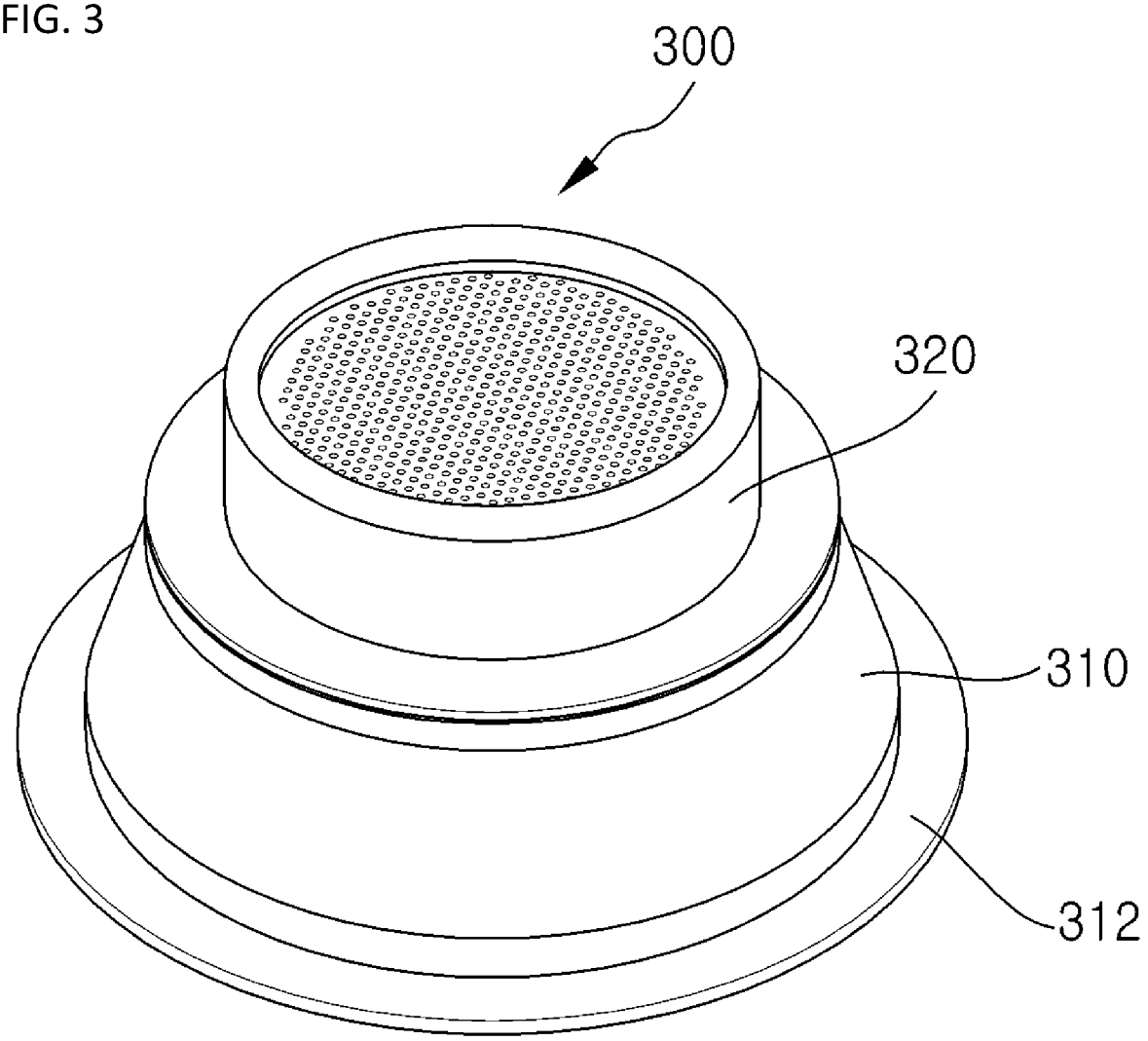
FIG. 3 is a perspective view showing the gate electrode shown in FIG. 2.
Figure 4:
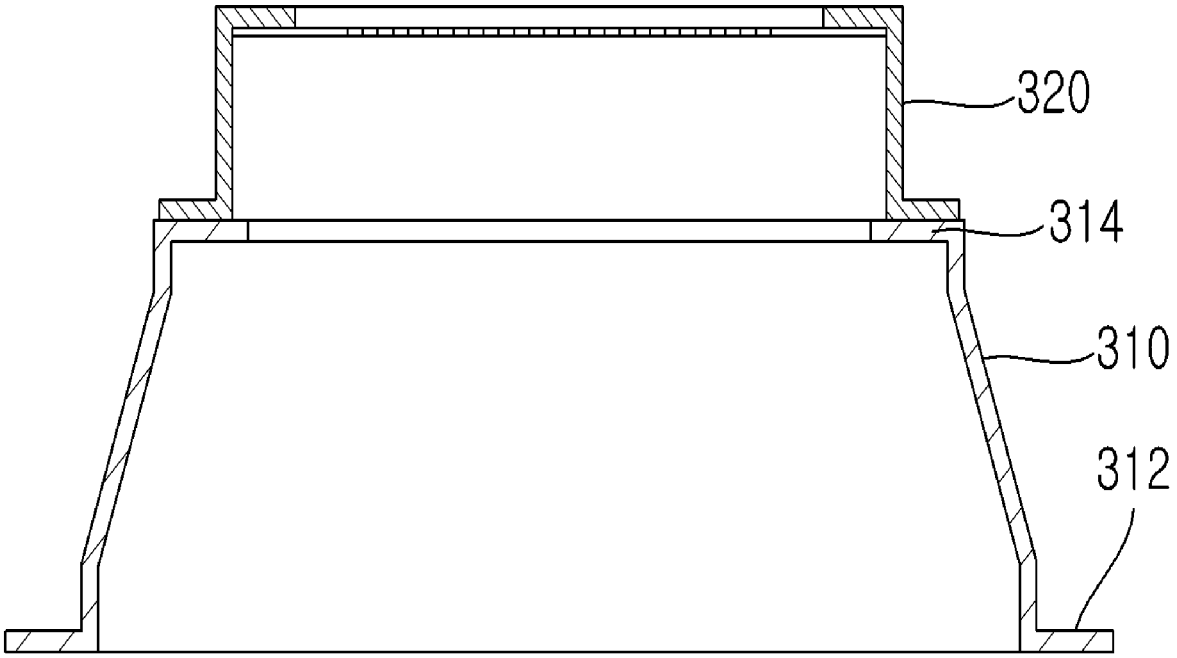
FIG. 4 is a cross-sectional view showing the gate electrode shown in FIG. 2.

Referring to FIG. 2, FIG. 3 and FIG. 4, the gate electrode 300 may include a first gate electrode portion 310 and a second gate electrode portion 320.

The first gate electrode part 310 is disposed between the inner insulating layer 200 and the outer insulating layer 400, and includes a gate terminal 312 coupled to a lower surface of the outer insulating layer 400, and a gate coupling portion 314 coupled to an upper surface of the inner insulating layer 200.

The second gate electrode portion 320 is coupled to the upper portion of the first gate electrode portion 310 to cover the upper end of the cathode electrode 100. The second gate electrode portion 320 is disposed close to the emitter 130 to form an electric field for electron emission. For example, the second gate electrode portion 320 may have a structure in which a plurality of gate holes are formed on the upper surface for passing electrons, or a thin metal plate having a plurality of gate holes is formed on the inner surface.

In this embodiment, the gate electrode 300 is formed to have a multi-layer structure separated into the first gate electrode portion 310 and the second gate electrode portion 320, but the present invention is not limited thereto, and the first gate electrode portion 310 and the second gate electrode portion 320 are formed integrally with each other.

The outer insulating layer 400 is formed in a cylindrical tube shape so as to surround the side surface of the gate electrode 300. The outer insulating layer 400 may be formed of an insulating material such as ceramic, glass, or silicon, such as the inner insulating layer 200, and may be formed of, for example, alumina ceramics.

The outer insulating layer 400 is formed in a cylindrical shape with an open top and a bottom. And, the diameter of the outer insulating layer 400 is larger than the diameter of the inner insulating layer 200 so as to accommodate the cathode electrode 100, the inner insulating layer 200 and the gate electrode 300 therein. Moreover, the outer insulating layer 400 is disposed in a coaxial direction with the inner insulating layer 200 to easily adjust an insulating distance between the electrodes.

The anode electrode 500 is arranged to face the cathode electrode 100 and is coupled to the outer insulating layer 400. A target 520 is disposed on the anode electrode 500 to collide with electrons emitted from the emitter 130 and emit X-rays. The target 520 may be used of, for example, a transmissive structure in which tungsten (W) is coated directly on the lower surface of a beryllium (Be) window, or a reflective structure in which a tungsten (W) block is formed on the anode electrode 500.

A high potential difference ranging from several kV to hundreds of kV is formed between the cathode electrode 100 and the anode electrode 500 by applying of voltage from an external power supply circuit. Electrons emitted from the emitter 130 are accelerated toward the anode electrode 500 by the potential difference between the cathode electrode 100 and the anode electrode 500 and X-rays are generated by accelerated electrons colliding with the target 520.

The X-ray tube 1000 may further include a focusing electrode 600 disposed on the gate electrode 300. The focusing electrode 600 forms an electric field for focusing electron beam traveling for the anode electrode 500 toward the target 520.

According to this embodiment of this configuration, the lower space of the inner insulating layer 200 is sealed by the cathode electrode 100, the space between the inner insulating layer 200 and the outer insulating layer 400 is sealed by the gate electrode 300, and the upper space of the outer insulating layer 400 is sealed by the anode electrode 500 so that the inner space of the x-ray tube 1000 is maintained in a vacuum state.

According to the present embodiment, a separate inner insulating layer 200 is additionally provided between the cathode electrode 100 and the outer insulating layer 400 in a direction coaxial with the outer insulating layer 400. Therefore, the insulating distances between the cathode electrode 100 and the gate electrode 300 and between the cathode electrode 100 and the anode electrode 500 can be easily adjusted and manufactured in accordance with the output specification of the emitter 130.

Figure 5:
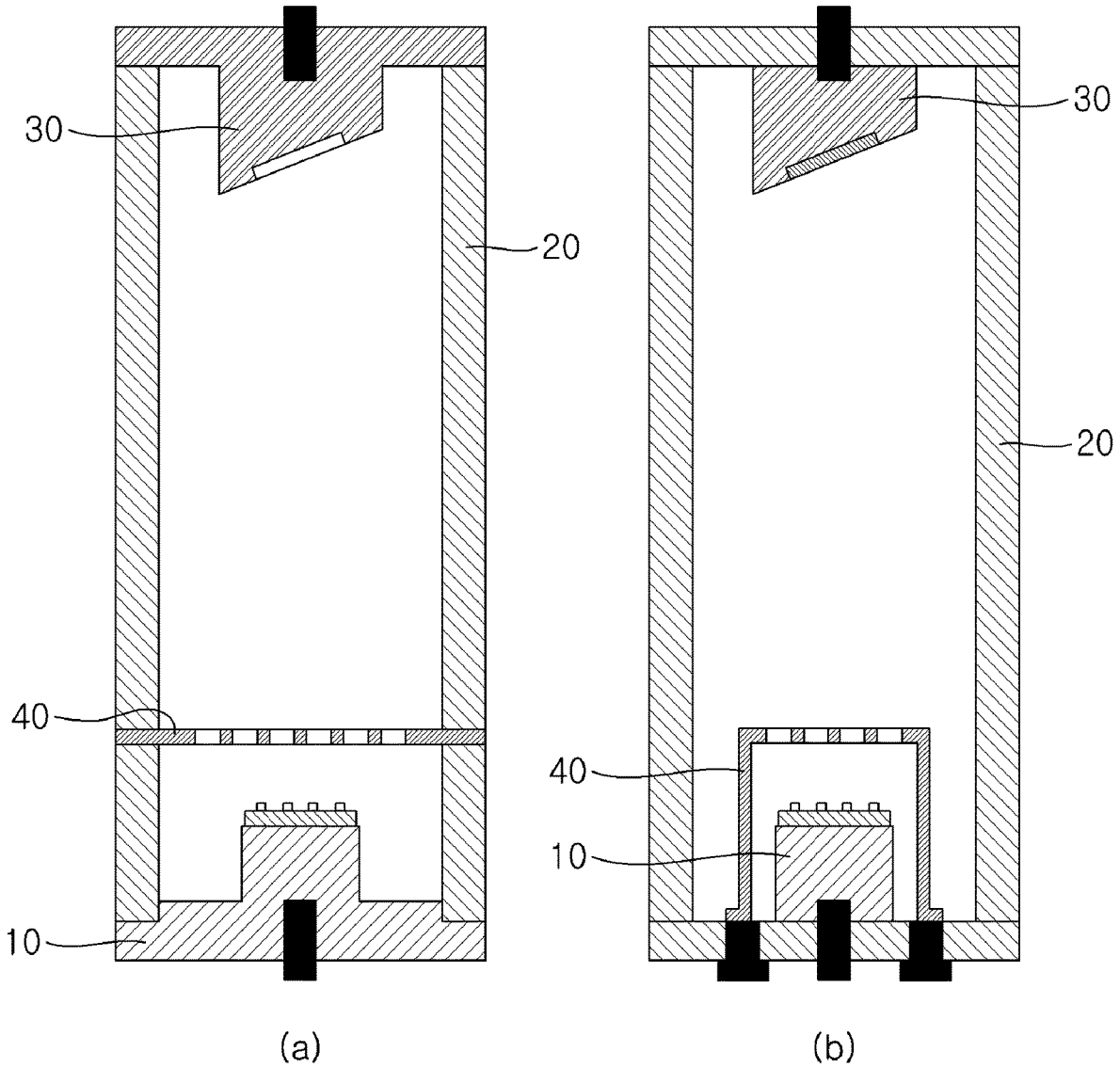
FIG. 5 is a cross-sectional view showing a conventional x-ray tube disclosed in a prior art.

FIG. 5 is a cross-sectional view showing a conventional x-ray tube disclosed in a prior art. In FIG. 5, (a) shows the x-ray tube disclosed in the prior art reference 1, and (b) shows the x-ray tube disclosed in the prior reference 2.

In the conventional X-ray tube disclosed in FIG. 5(*a*), the cathode electrode 10 is bonded to the lower surface of the external insulating layer 20, and the anode electrode 30 is bonded to the external insulating layer 20 The insulating distance between the cathode electrode 10 and the anode electrode 30 corresponds to the length of the external insulating layer 20. The insulating distance between the gate electrode 40 and the anode electrode 30 is shorter than the length of the external insulating layer 20 because the gate electrode 40 is disposed on the cathode electrode 10 and exposed to the side surface of the external insulating layer 20. Therefore, a relatively low insulating capability is obtained. To improve this, a structure has been developed in which insulating capabilities between the cathode and the anode, between the gate and the anode are improved.

In the conventional X-ray tube disclosed in FIG. 5(*b*), in order to increase the insulation distance between the anode electrode 30 and the gate electrode 40 and increase the efficiency of manufacturing process, the terminal portion of the gate electrode 40 is exposed in the lower direction of the external insulating layer 20 like the cathode electrode 10. The insulating capabilities between the cathode and the anode, between the gate and the anode are improved as compared with the X-ray tube shown in the above (a). Since the cathode electrode 10 and the gate electrode 40 are arranged on the same line, the convenience of the manufacturing process is secured. However, the relative distance between the cathode electrode 10 and the gate electrode 40 is shorter so that the insulating capability is likely to be reduced.

Figure 6:
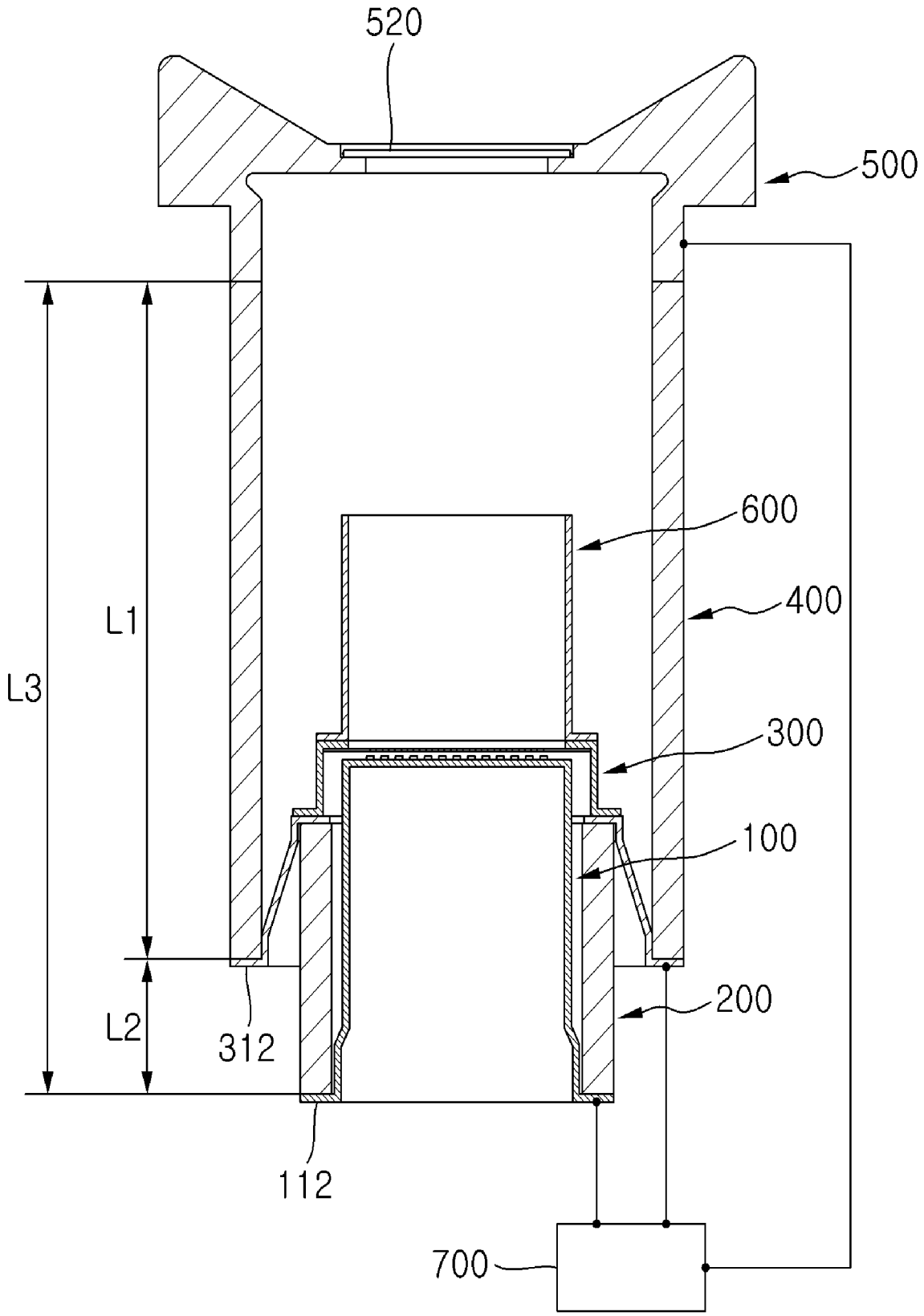
FIG. 6 is a view showing an effect of increasing an insulation distance in the X-ray tube according to the embodiment of FIG. 2.
Figure 7:
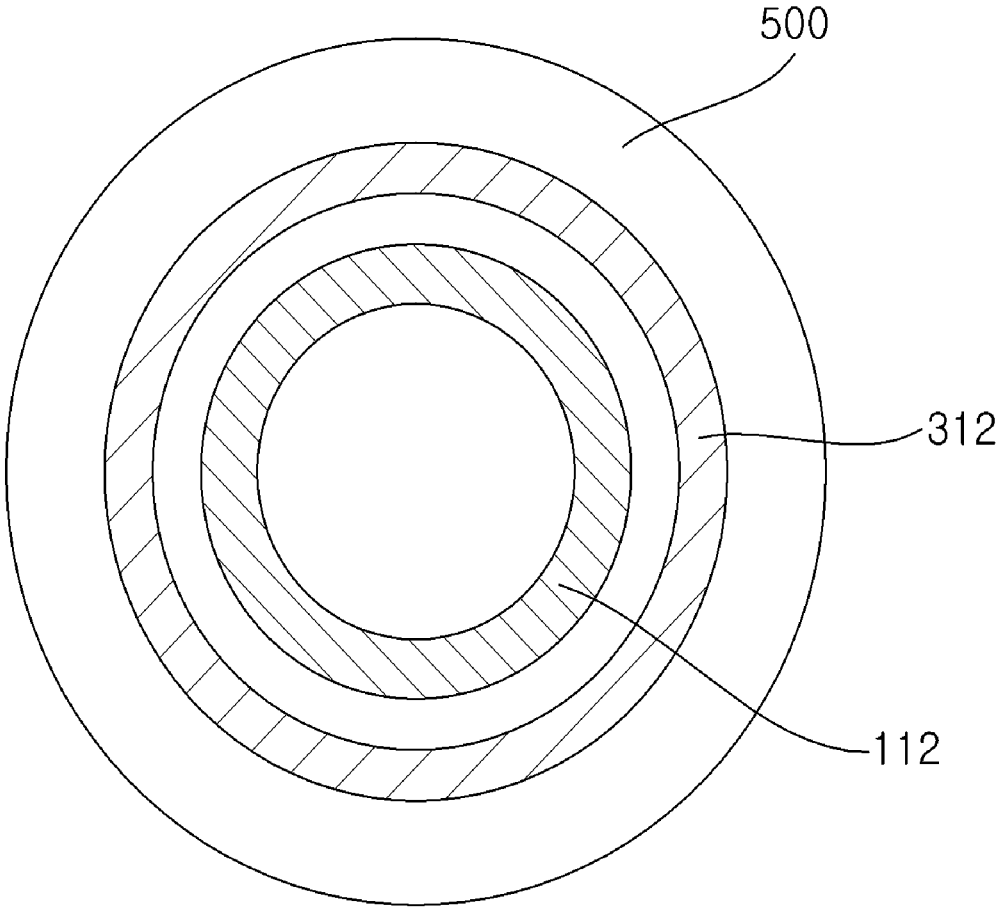
FIG. 7 is a bottom view showing an X-ray tube according to the embodiment of FIG. 2

FIG. 6 is a view showing n effect of increasing an insulation distance in the X-ray tube according to the embodiment of FIG. 2, and FIG. 7 is a bottom view showing an X-ray tube according to the embodiment of FIG. 2.

Referring FIGS. 6 and 7, the X-ray tube 1000 according to the embodiment of the present invention has a shape in which the inner insulating layers 200 is disposed between the cathode electrode 100 and the outer insulating layer 400 in a direction coaxial with the outer insulating layer 400, and a part of the inner insulating layer 200 protrudes to the lower portion of the outer insulating layer 400.

Under this structure, the insulating distance between the cathode electrode 100 and the anode electrode 500 becomes L3 which is increased by the length L2 protruded from the outer insulating layer 400. It is possible to obtain the highest insulating capability than the techniques presented in the existing prior art references.

Moreover, since the gate electrode 300 has a structure in which the gate electrode 300 hermetically seals the lower surface of the outer insulating layer 400, the insulation distance between the gate electrode 300 and the anode electrode 500 is set to L1 corresponding to the length of the outer insulating layer 400. Therefore, it is possible to obtain higher insulating capability than the prior art reference 1 in which a pate electrode is exposed on the side of an external insulating layer, sane insulating capability as that of the prior art reference 2 in which a gate electrode is disposed on the bottom of the external insulating layer.

Meanwhile, since the cathode electrode 100 hermetically seals the lower surface of the inner insulating layer 200 and the gate electrode 300 hermetically seals the lower surface of the outer insulating layer 400, the insulation distance between the cathode electrode 100 and the gate electrode 312 has an insulating capability corresponding to not less than the length L2 of the inner insulating layer 200 protruding to the outside of the outer insulating layer 400. Thereby, it ensures the highest insulating capability compared with the prior art references.

Since the length of the inner insulating layer 200 or the relative length between the inner insulating layer 200 and the outer insulating layer 400 can be easily adjusted, it is possible to easily secure the insulating capability by the output specification of the emitter 130 through adjustment of the relative distance between the cathode electrode 100 and the gate electrode 300.

As shown FIGS. 6 and 7, the cathode terminal portion 112 of the cathode electrode 100 is coupled to the lower surface of the inner insulating layer 200 for electrical connection with the external power supply circuit 700 and is exposed downward. And the gate terminal portion 312 of the gate electrode 300 is coupled to the lower surface of the outer insulating layer 400 and is exposed downward. Moreover, the cathode terminal portion 112 and the gate terminal portion 312 are spaced apart concentrically each other in the same direction toward the lower portion of the X-ray tube 1000 when they are viewed from the bottom.

As described above, by connecting the gate electrode 300 and the external power supply circuit 700 through the connector (not shown) or the like in the same direction as the cathode electrode 100 in the lower direction of the outer insulating layer 400, the manufacturing process for the outer insulating layer 400 is simplified as compared with the conventional structure in which the terminal portion of the outer insulating layer 400 is exposed to the side surface of the outer insulating layer 400. Furthermore, by forming the cathode terminal portion 112 and the gate terminal portion 312 so as to face in the same direction, it is possible to implement a structure that may be mounted on a system through a simpler connector configuration, when connecting a connector for mounting the X-ray tube 1000 to an external system such as an X-ray generator.

Hereinafter, a method of manufacturing an X-ray tube according to an embodiment of the present invention will be described.

Referring to FIG. 2, an X-ray tube manufacturing method according to an embodiment of the present invention includes forming an inner insulating layer 200, forming a cathode electrode 100 which is spaced apart from an upper opening surface of the inner insulating layer 200 by a predetermined distance and is extended upward while hermetically sealing a lower surface of the inner insulating layer 200, connecting the inner insulating layer 200 and the cathode electrode 100 through brazing, forming an outer insulating layer 400 in a coaxial direction by which is outward spaced apart from the inner insulating layer 200 by a predetermined distance, forming a gate electrode 300 which is spaced apart from the cathode electrode 100 by a predetermined distance and is extended upward while hermetically sealing a lower surface of the outer insulating layer 400, connecting the outer insulating layer 400 and the gate electrode 300 through brazing, and, forming an anode electrode 500 extending upwardly while hermetically sealing an upper surface of the outer insulating layer 400 and hermetically sealing an opening surface of the outer insulating layer 200.

When the inner insulating layer 200 and the cathode electrode 100 are coupled each other and the lower surface of the inner insulating layer 200 is hermetically sealed by the cathode electrode 100, the cathode terminal portion 112 is formed so as to completely cover the lower surface of the inner insulating layer 200. Thereafter, a process of joining the outer insulating layer 400 and the gate electrode 300 proceeds. The process of coupling the gate electrode 300, as shown in FIGS. 3 and 4, may include forming a first gate electrode portion 310 and a second gate electrode portion 320. When forming a first gate electrode portion 310, the first gate electrode portion 310 having a gate terminal unit 312 formed at a lower end thereof and a gate coupling portion 314 formed at an upper end thereof, the gate coupling portion 314 is coupled to an upper surface of the inner insulating layer 200. When forming the second gate electrode portion 320, the second gate electrode portion 320 is coupled to the upper portion of the first gate electrode portion 310 so as to cover the upper end of the cathode electrode 100 disposed inside the inner insulating layer 200.

Here, the first gate electrode portion 310 and the inner insulating layer 200 made of metal materials are completely connected by performing a high temperature brazing process in a state where the first gate electrode portion 310 is coupled to the inner insulating layer 200. In addition, the gate electrode 300 may be formed as an integrated structure instead of a multi-layer structure separated by the first gate electrode portion 310 and the second gate electrode portion 320.

The process of disposing the focusing electrode 600 for focusing the electron beam that advances toward the anode electrode 500 may be performed on the gate electrode 300 after the gate electrode 300 is coupled to the inner insulating layer 200.

Thereafter, a process of joining the outer insulating layer 400 to the outside of the gate electrode 300 in a direction coaxial with the internal insulating layer 200 is performed. The lower end of the gate electrode 300 is coupled to the lower surface of the external insulating layer 400 to form the gate terminal portion 312 when the gate electrode 300 and the outer insulating layer 400 are connected. When the gate electrode 300 and the outer insulating layer 400 are coupled to each other, at least a portion of the inner insulating layer 200 is exposed to the outside of the outer insulating layer 400.

The process of connecting the outer insulating layer 400 and the anode electrode 500 is performed separately from connecting of the gate electrode 300 and the outer insulating layer 400. The connecting process of the outer insulating layer 400 and the anode electrode 500 may be performed before or after connecting the outer insulating layer 400 to the gate electrode 300.

While the first gate electrode portion 310 and the anode electrode 500 made of metal materials are completely connected by performing a low temperature brazing process in a state where the outer insulating layer 400 is connected to the gate electrode 300 and the outer insulating layer 400 is connected to the anode electrode 500.

According to this manufacturing process, the lower space of the inner insulating layer 200 is hermetically sealed through the coupling of the cathode electrode 100 and the inner insulating tube 200. And, the space between the inner insulating layer 200 and the outer insulating layer 400 is sealed through couplings between the gate electrode 300 and the outer insulating layer 400 and between the gate electrode 300 and the inner insulating layer 200. Finally, the upper space of the insulating layer 400 is sealed through the coupling between the outer insulating layer 400 and the anode electrode 500 Thereby the inner space of the manufactured X-ray tube 1000 is maintained in a vacuum sealed state.

While the present invention has been described in connection with what is presently considered to be practical exemplary embodiments, it is to be understood that the invention is not limited to the disclosed embodiments, but, on the contrary, It will be understood by those skilled in the art that various changes in form and details may be made therein without departing from the spirit and scope of the invention.

The invention claimed is:

1. A cylindrical X-ray tube having an outer insulating layer, a cathode electrode and an anode electrode disposed at both ends of the outer insulating layer, a gate electrode disposed between the cathode electrode and the anode electrode, an emitter, and a target, comprises an inner insulating layer which is disposed between the cathode electrode and the outer insulating layer, is formed to extend downward in a coaxial direction with the outer insulating layer, and is pre-adjusted in order to secure an insulating distance between the cathode electrode and the gate electrode.

2. The cylindrical X-ray tube of claim 1, wherein the cathode electrode is spaced apart from the gate electrode by a predetermined distance, hermetically seals a bottom surface of the inner insulating layer so as not to be exposed the bottom surface of the inner insulating layer to outside, and extends upward in a coaxial direction with the inner insulating layer.

3. The cylindrical X-ray tube of claim 1, wherein bottom surfaces of the cathode electrode and the gate electrode are electrically contacted to an external power supply circuit.

4. The cylindrical X-ray tube of claim 1, wherein the emitter is formed of a nanostructure made of carbon nanotubes.

5. The cylindrical X-ray tube of claim 1, wherein the gate electrode is spaced apart from the cathode electrode by a predetermined distance, hermetically seals the bottom surface of the outer insulating layer so as not to be exposed the bottom surface of the outer insulating layer to the outside, and extends upward in a coaxial direction with e outer insulating layer.

6. The cylindrical X-ray tube of claim 1, wherein a lower space of the inner insulating layer is hermetically sealed by the cathode electrode, a space between the inner insulating layer and the outer insulating layer is hermetically sealed by the gate electrode, and an upper space of the outer insulating layer is hermetically sealed by the anode electrode.

7. The cylindrical X-ray tube of claim 1 further comprises a focusing electrode disposed on the gate electrode, for focusing electron beam accelerating toward the anode electrode.

8. A manufacturing method of a cylindrical X-ray tube comprising;

forming an inner insulating layer;

forming a cathode electrode which is spaced apart from an upper opening surface of the inner insulating layer by a predetermined distance, is extended upward while hermetically sealing a lower surface of the inner insulating;

forming an outer insulating layer in a coaxial direction by which is outward spaced apart from the inner insulating layer by a predetermined distance;

forming a gate electrode which is spaced apart from the cathode electrode by a predetermined distance, is extended upward while hermetically sealing a lower surface of the outer insulating layer; and, forming an anode electrode by hermetically sealing an upper surface of the outer insulating layer, extending upwardly, and hermetically sealing an opening surface of the outer insulating layer.

9. The manufacturing method of a cylindrical X-ray tube of claim 8 further comprises disposing an emitter on the cathode electrode after the step of forming a cathode electrode.

10. The manufacturing method of a cylindrical X-ray tube of claim 9, wherein the emitter is formed of a nanostructure made of carbon nanotubes.

11. The manufacturing method of a cylindrical X-ray tube of claim 8 further comprises forming a focusing electrode on the gate electrode in order to focus electron beam traveling toward the anode electrode before the step of forming an anode electrode.

* * * * *